US007966757B2

(12) United States Patent
Hyung-Chul

(10) Patent No.: US 7,966,757 B2
(45) Date of Patent: Jun. 28, 2011

(54) APPARATUS FOR SUPPORTING BANNER

(76) Inventor: Cho Hyung-Chul, Gyeonggi-Do (KR)

( * ) Notice: Subject to any disclaimer, the term of this patent is extended or adjusted under 35 U.S.C. 154(b) by 0 days.

(21) Appl. No.: 12/366,341

(22) Filed: Feb. 5, 2009

(65) Prior Publication Data

US 2010/0037499 A1 Feb. 18, 2010

(30) Foreign Application Priority Data

May 4, 2008 (CN) ..... 2008 2 0112800

(51) Int. Cl.
*G09F 17/00* (2006.01)

(52) U.S. Cl. ..... 40/603; 160/329; 248/166; 248/370

(58) Field of Classification Search ..... 40/603, 40/746; 248/164, 127, 370, 166; 160/328, 160/329, 351, 354, 368.1
See application file for complete search history.

(56) References Cited

U.S. PATENT DOCUMENTS 1,699,735 A * 1/1929 Dabrohua et al. ..... 40/603
1,845,921 A * 2/1932 Karwoski ..... 248/155.1
1,870,798 A * 8/1932 Einson ..... 40/603
2,632,971 A * 3/1953 Manczek et al. ..... 40/741
2,862,552 A * 12/1958 Franz ..... 160/368.1
5,090,143 A * 2/1992 Schier et al. ..... 40/790
5,428,913 A 7/1995 Hillstrom
5,517,778 A 5/1996 Simson
6,192,611 B1 2/2001 Molla
6,332,284 B1 * 12/2001 Tafforeau ..... 40/603
6,378,820 B1 4/2002 Mooney et al.
6,457,684 B1 10/2002 McKendry
6,493,973 B1 12/2002 Nelson
6,643,966 B2 11/2003 Schmitt

* cited by examiner

*Primary Examiner* — Joanne Silbermann
*Assistant Examiner* — Kristina Staley
(74) *Attorney, Agent, or Firm* — Thorpe North & Western LLP

(57) ABSTRACT

Disclosed is an apparatus for supporting a banner. The apparatus includes a plurality of frames, each being formed by stacking a plurality of plates, a connection unit having an interior cover and an exterior cover connected to each other by inserting the plurality of frames into the interior and exterior covers, respectively, a supporter provided to each end of the plurality of frames to support the banner, and a support frame connected to one side of the connection unit to support the plurality of frames. In the apparatus, the plurality of environmentally friendly bamboo plates are adhered to each other and integrated into a single body, thereby obtaining both elasticity and rigidity of bamboo.

17 Claims, 22 Drawing Sheets

APPARATUS FOR SUPPORTING BANNER

PRIORITY CLAIMS

This application claims priority to Korean Application Number 10-2008-107929 filed Oct. 31, 2008, China Patent Application Number 200820112800 filed May 4, 2008, and China Patent Application Number 2008820112796 filed May 4, 2008.

BACKGROUND OF THE INVENTION

1. Field of the Invention

The present invention relates to an apparatus for supporting a banner and, more particularly, to an apparatus for supporting a banner, which is environmentally friendly and has an improved structure with enhanced rigidity.

2. Description of the Related Art

With recent development in advertisement or exhibition, demand for a banner has been increasing. Such a banner can stand upright with advertising slogans or various messages supported by a banner supporter.

Generally, the banner supporter includes a plurality of frames, a connection unit for connecting the frames, and a supporter provided to the plurality of frames to support the banner.

The plural frames are unfolded to support the banner, and folded to be kept in storage after an exhibition.

Further, the plural frames are made of aluminum or fiber glass to maintain rigidity, and are shaped like a hollow pole.

However, the conventional banner supporter is made of aluminum or the like, thereby causing environmental contamination.

Also, even when the banner supporter is folded, it occupies so large a space that 25 the apparatus for supporting a banner suffers difficulty in storage.

Further, the banner supporter is likely to break due to applied external force because it is made of a hard material lacking in elasticity.

SUMMARY OF THE INVENTION

The present invention is conceived to solve the problems of the conventional technique, and an aspect of the present invention is to provide an apparatus for supporting a banner, which is made of an environmentally friendly material to prevent environmental contamination upon disposal and includes a plurality of elastic plates to obtain rigidity.

Another aspect of the present invention is to provide an apparatus for supporting a banner, which has an improved structure to be easily folded and stored in a small space.

According to an aspect of the present invention, an apparatus for supporting a banner is provided. The apparatus includes a plurality of frames, each being formed by stacking a plurality of plates; a connection unit having an interior cover and an exterior cover connected to each other by inserting the plurality of frames into the interior and exterior covers, respectively; a supporter provided to each end of the plurality of frames to support the banner; and a support frame connected to one side of the connection unit to support the plurality of frames.

BRIEF DESCRIPTION OF THE DRAWINGS

The above and other aspects, features and advantages of the present invention will become apparent from the following description of an exemplary embodiment given in conjunction with the accompanying drawings, in which.

DETAILED DESCRIPTION OF THE EMBODIMENT

Embodiments of the present invention will now be described in detail with reference to the accompanying drawings.

Figure 1:
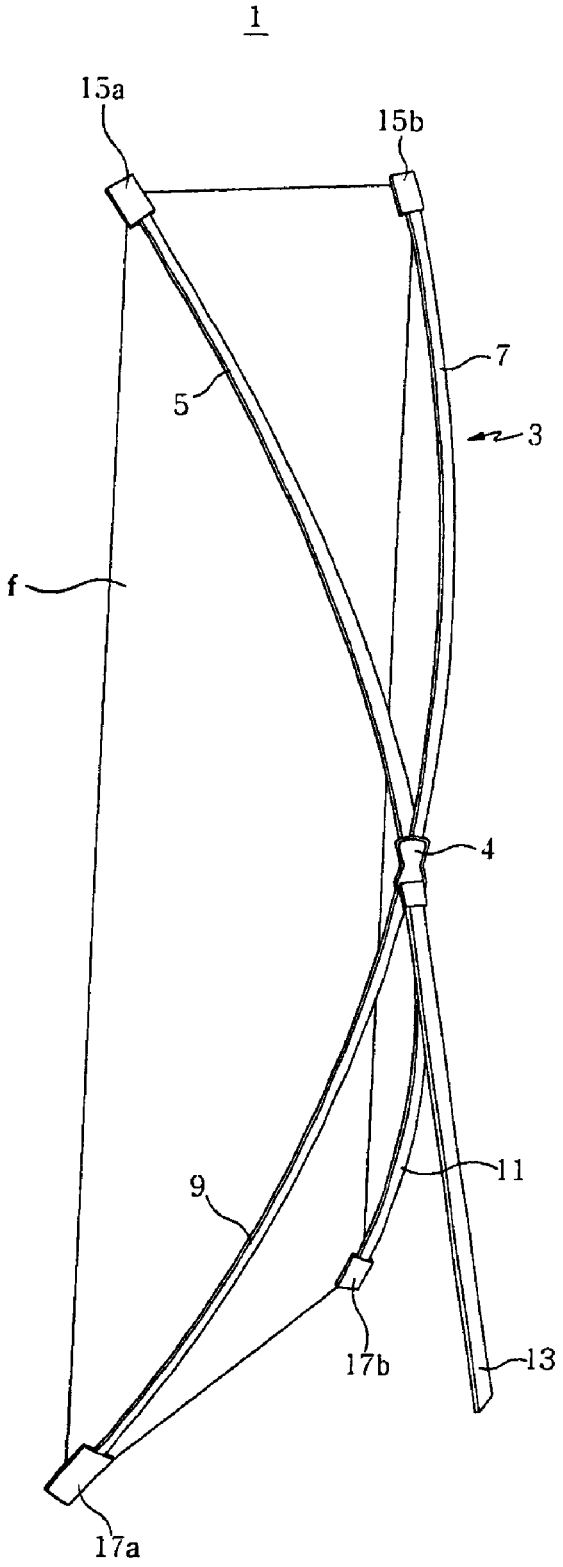
FIG. 1 is a perspective view of an apparatus for supporting a banner according to an embodiment of the present invention.
Figure 2:
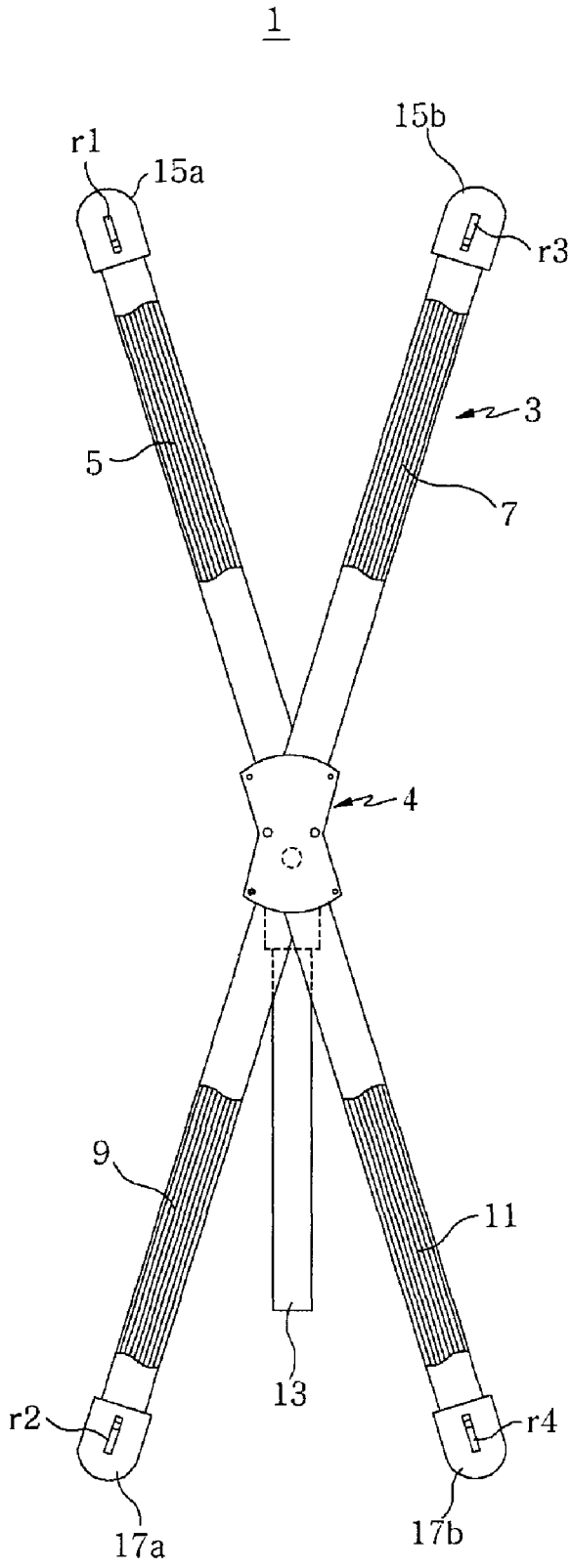
FIG. 2 is a front view of the apparatus shown in FIG. 1.
Figure 3:
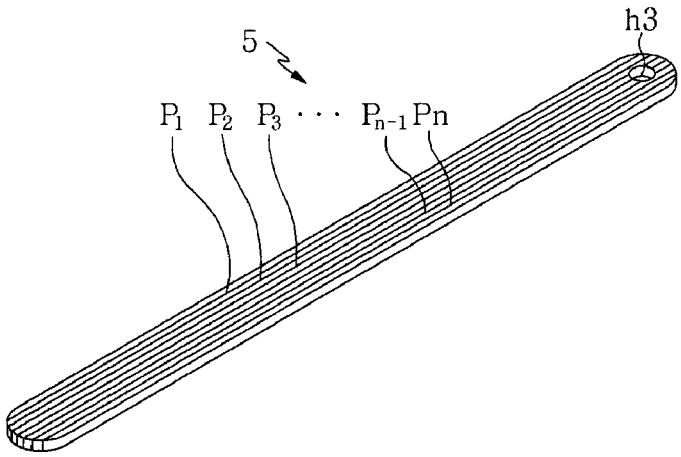
FIG. 3 is a perspective view of a frame shown in FIG. 1.
Figure 4:
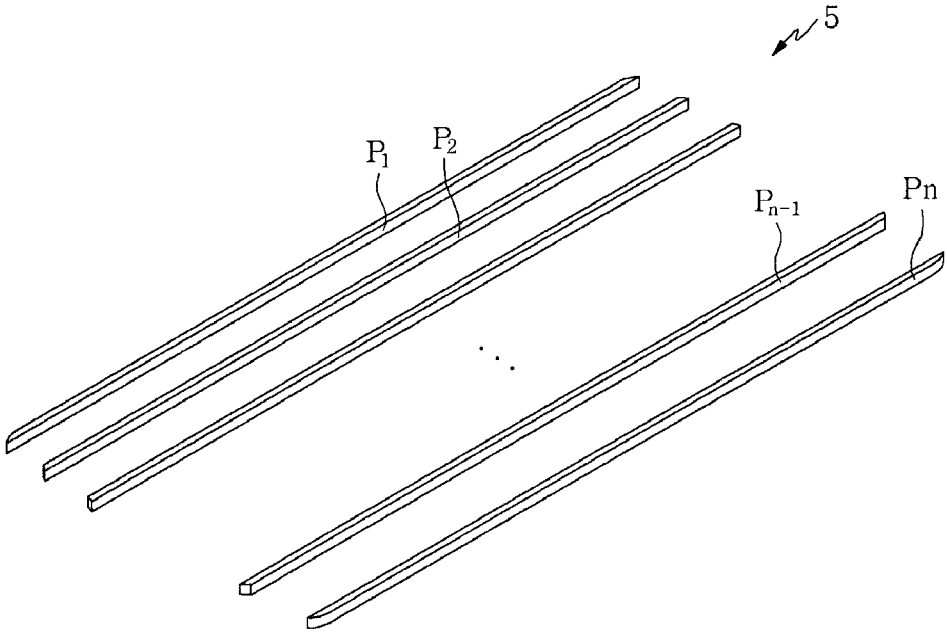
FIG. 4 is an exploded perspective view of the frame shown in FIG. 3.
Figure 5:
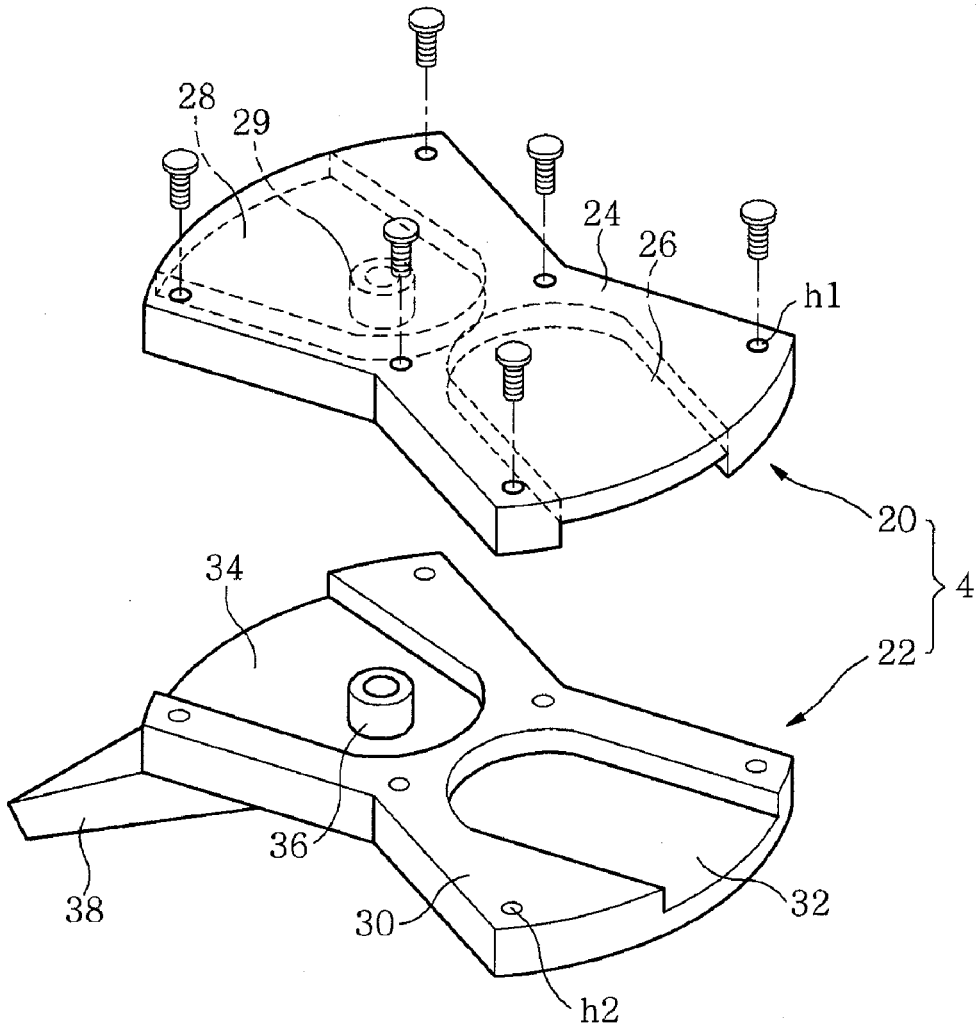
FIG. 5 is an exploded perspective view of a connection unit shown in FIG. 1.
Figure 6:
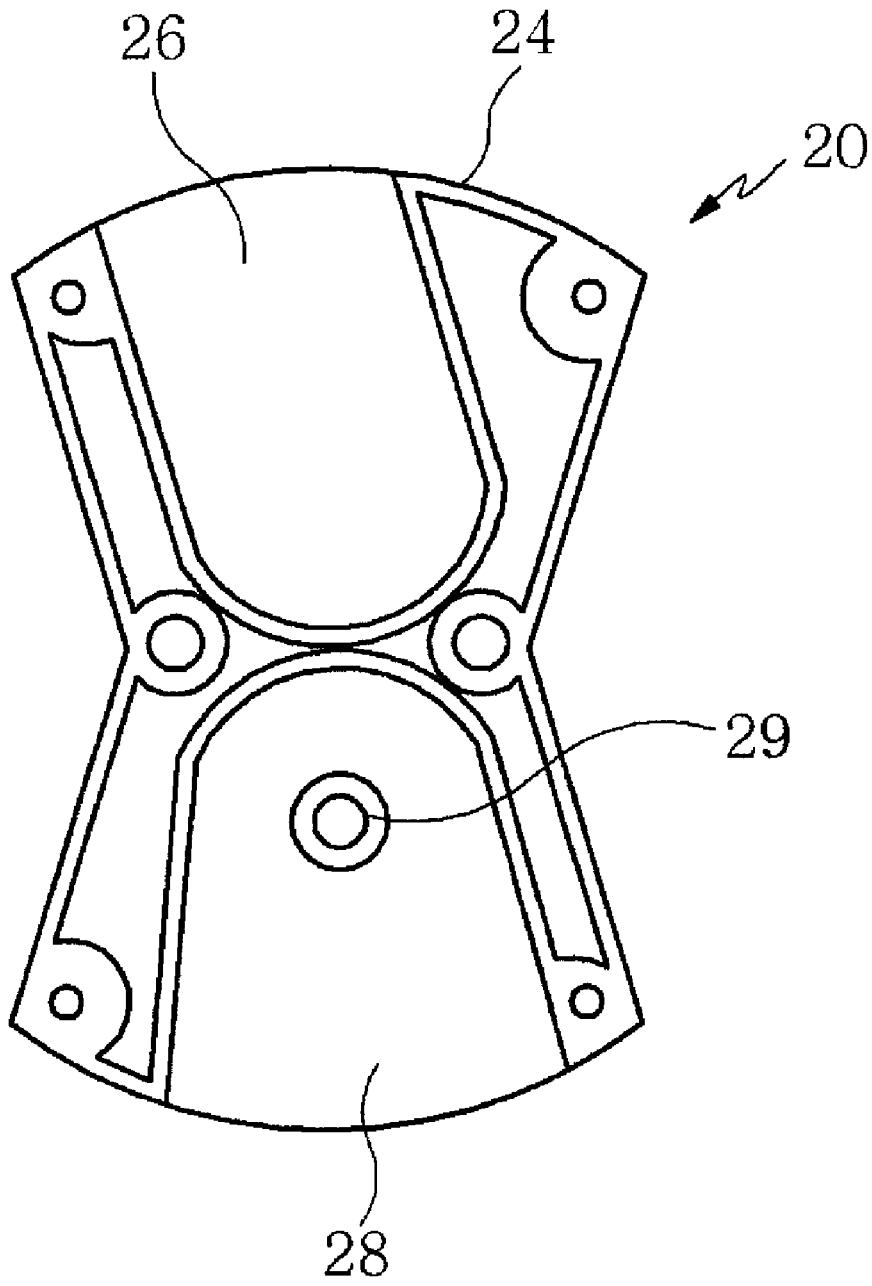
FIG. 6 is a view illustrating an inner structure of an interior cover shown in FIG. 5.
Figure 7:
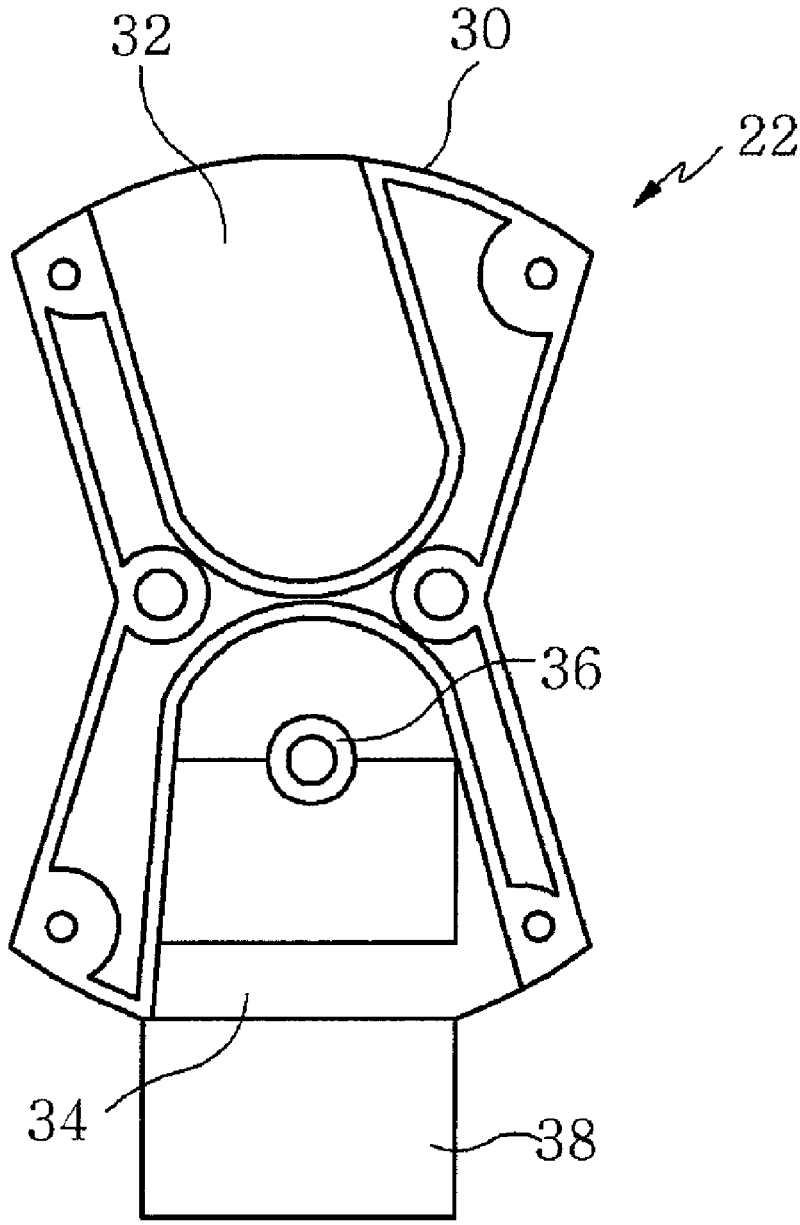
FIG. 7 is a view illustrating an inner structure of an exterior cover shown in FIG. 5.
Figure 8:
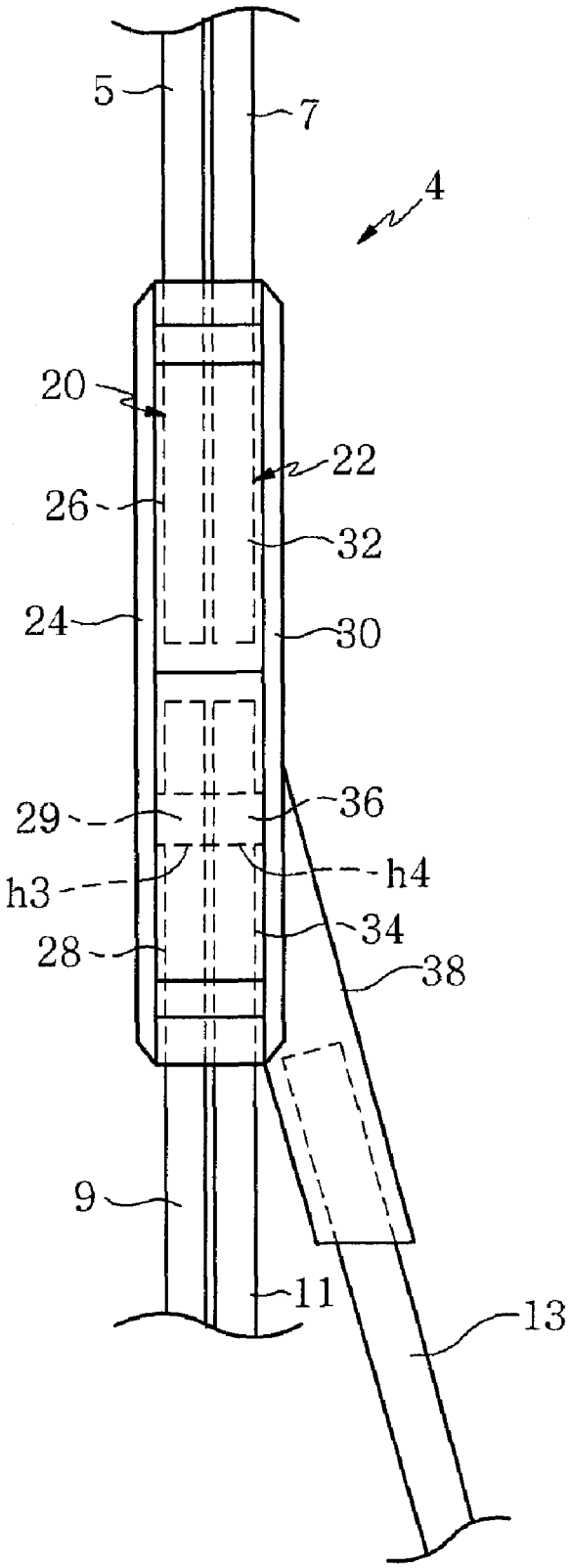
FIG. 8 is a view illustrating the frame inserted into the connection unit of FIG. 5.
Figure 9:
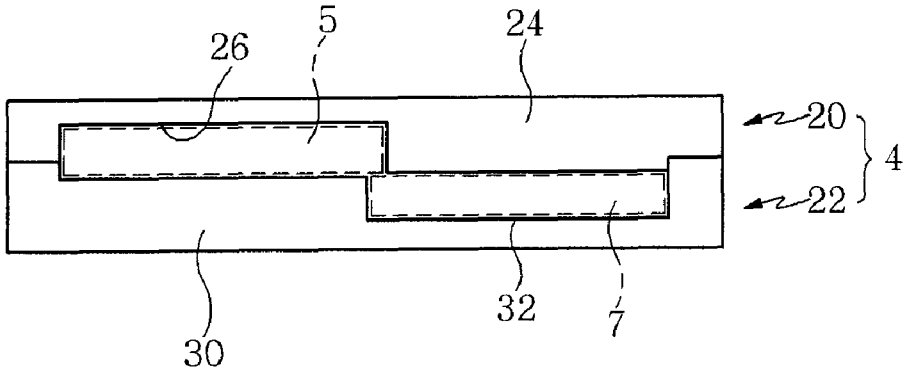
FIG. 9 is a view illustrating an upper part of the connection unit of FIG. 5.

FIG. 1 is a perspective view of an apparatus for supporting a banner according to an embodiment of the present invention, FIG. 2 is a front view of the apparatus shown in FIG. 1, FIG. 3 is a perspective view of a frame shown in FIG. 1, and FIG. 4 is an exploded perspective view of the frame shown in FIG. 3.

Referring to the drawings, the banner supporting apparatus 1 according to an embodiment of this invention includes a plurality of frames 5, 9, 7, 11, each formed by stacking a plurality of bamboo plates P1, P2, . . . , Pn; a connection unit 4 connecting the plural frames 5, 9, 7, 11 to one another; supporters 15*a*, 15*b*, 17*a*, 17*b* provided to ends of the plural frames 5, 9, 7, 11 to connect to a banner f; and a support frame 13 connected to one side of the connection unit 4 to support the plural frames 5, 9, 7, 11.

In the apparatus this embodiment, the plurality of frames 5, 9, 7, 11 includes first and third frames 5, 7 to support upper opposite ends of the banner f, and second and fourth frames 9, 11 to support lower opposite ends of the banner f.

Each of the frames 5, 9, 7, 11 is made of an environmentally friendly material, such as bamboo, and has a structure wherein the plurality of bamboo plates P1, P2, . . . , Pn are adhered to each other with adhesive or the like. That is, the adhesive is applied to both sides of the plural thin plates P1, P2, . . . , Pn, which in turn are compressed to one another, thereby forming an integrated body of the frames 5, 9, 7, 11.

Thus, the plurality of bamboo plates P1, P2, . . . , Pn are bonded to one another to form each of the frames 5, 9, 7, 11, so that these frames 5, 9, 7, 11 may have improved hardness while maintaining the elasticity of the bamboo.

Here, although the present invention is not limited to a specific adhesive, a lumber bond/ureaformaldehyde resin may be advantageously used as the adhesive. The lumber bond is an organic polymer manufactured by heating urea and formaldehyde in a weak alkali such as pyridine and ammonia.

In the description of this embodiment, the plurality of bamboo plates are described as being integrated by the adhesive, but the present invention is not limited thereto. Alternatively, a screw coupling method, a wire coupling method, etc. may be used.

The connection unit 4 includes an interior cover 20 and an exterior cover 22 to connect the plural frames 5, 9, 7, 11, as shown in FIGS. 5 to 11.

The interior cover 20 includes an interior case 24, a first insertion part 26 formed at one side of the interior case 24, a second insertion part 28 formed at the other side of the interior case 24, and a first projection 29 protruding from the second insertion part 28.

Further, the exterior cover 22 includes an exterior case 30, a third insertion part 32 formed at one side of the exterior case 30, a fourth insertion part 34 formed at the other side of the exterior case 30, a second projection 36 protruding from the fourth insertion part 34, and a fifth insertion part 38 protruding from the exterior case 30 such that the support frame can be inserted into the fifth insertion part 38.

With this configuration, the interior and exterior covers 20, 22 are formed with screw holes h1, h2, respectively, and bolts are fastened to the screw holes h1, h2, so that the interior and exterior covers 20, 22 can be coupled to each other.

Further, the first insertion part 26 and the second insertion part 32 have a constant depth, and are misaligned from each other. First and third frames 5, 7 are securely inserted into the first and third insertion parts 26, 32, respectively.

Here, the first and third insertion parts 26, 32 have such a width that the first and third frames 5, 7 can be inserted into the first and third insertion parts 26, 32, respectively Thus, the first and third frames 5, 7 can be firmly inserted into the first and third insertion parts 26, 32, respectively.

Therefore, the first and third frames 5, 7 are inserted into the top of the connection unit 4 to support an upper part of the banner. Further, when the banner supporting apparatus 1 is disassembled for storage, the first and third frames 5, 7 are separated from the first and third insertion parts 26, 32, respectively, so that the apparatus can be easily disassembled for storage.

Also, a second frame 9 is inserted into the second insertion part 28, and a fourth frame 11 is inserted into the fourth insertion part 34. Here, the second and fourth insertion parts 28, 34 become wider in the radial direction.

Further, the first projection 29 protrudes from a bottom surface of the second insertion part 28, and the second projection 36 protrudes from a bottom surface of the fourth insertion part 34.

When the second and fourth frames 9, 11 are inserted into the second and fourth insertion parts 28, 34, respectively, the first and second projections 29, 36 pass through holes h3, h4 formed at ends of the second and fourth frames 9, 11, so that the second and fourth frames 9, 11 can be connected to the second and fourth insertion parts 28, 34, respectively.

Figure 10:
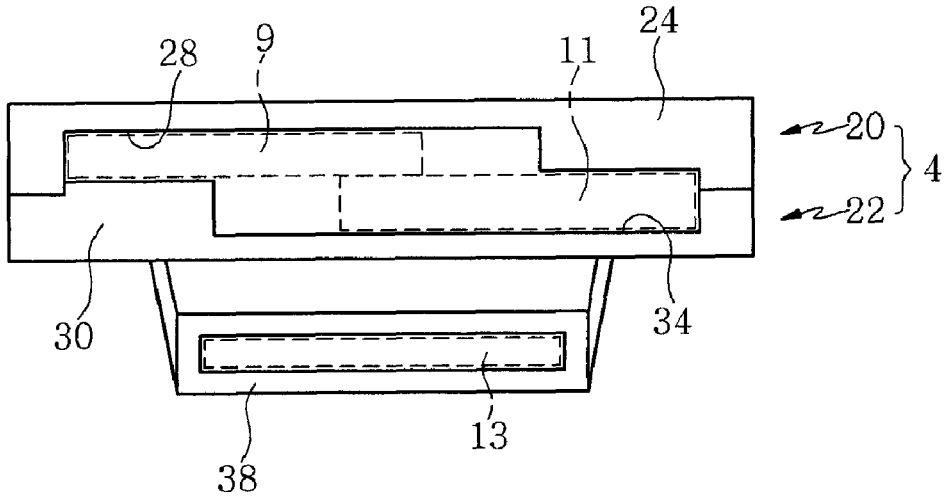
FIG. 10 is a view illustrating a lower part of the exterior cover shown in FIG. 5.
Figure 11:
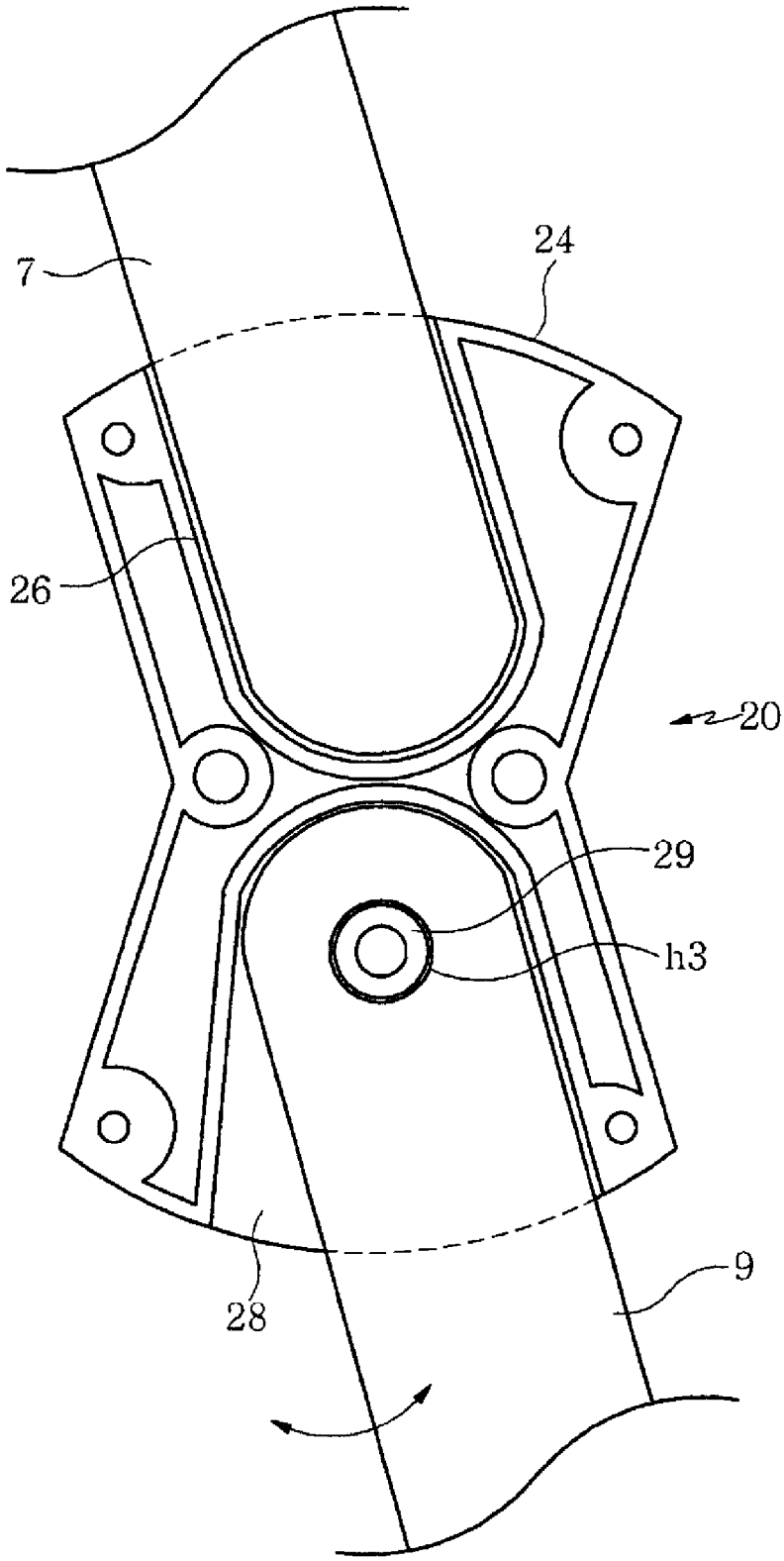
FIG. 11 is a view illustrating operation of the frame inserted into the connection unit of FIG. 5.

Referring to FIG. 10, the second and fourth insertion parts 28, 34 are arranged up and down, and middle parts thereof are overlapped with each other, so that the second and fourth frames 9, 11 can rotate in the clockwise and counterclockwise directions, respectively.

Accordingly, the second and fourth frames 9, 11 are unfolded to support the banner, and folded for storage.

The fifth insertion part 38 protrudes from the back of the exterior cover 22 at a predetermined angle.

Further, the support frame 13 is inserted into the fifth insertion part 38 and serves as a fulcrum. Here, the support frame 13 is separably inserted into the fifth insertion part 38.

When the support frame 13 is inserted into the fifth insertion part 38, the banner supporting apparatus 1 can be supported. On the other hand, when the support frame 13 is separated from the fifth insertion part 38, the apparatus 1 can be folded.

As described above, the first to fourth frames 5, 9, 7, 11, and the support frame 13 are inserted into the first to fifth insertion parts 26, 28, 32, 34, 38 of the connection unit 4, respectively, and the second and fourth frames 9, 11 are unfolded, so that the banner supporting apparatus 1 can stand upright.

Figure 12:
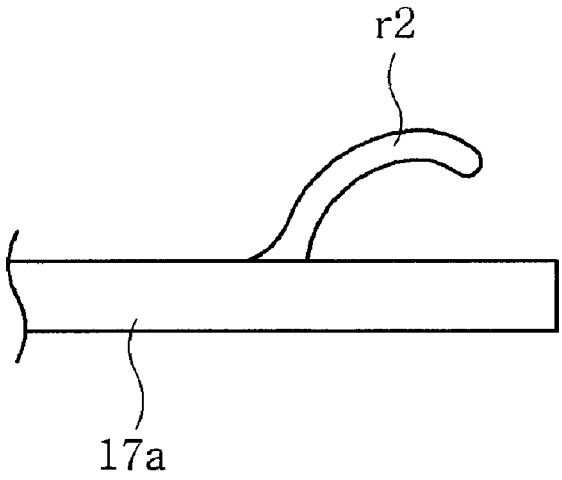
FIG. 12 is a side view of a cap shown in FIG. 1.

Meanwhile, referring to FIGS. 2 and 12, the supporters 15*a*, 15*b*, 17*a*, 17*b* include four caps, i.e., a first cap 15*a*, a second cap 15*b*, a third cap 17*a*, and a fourth cap 17*b*, and thus can be inserted into the ends of the first to fourth frames 5, 9, 7, 11, respectively.

The first to fourth caps 15*a*, 15*b*, 17*a*, 17*b* have hooks r1, r2, r3, r4 protruding from one side thereof, respectively. The hooks r1, r2, r3, r4 are inserted into holes (not shown) formed at corners of the banner, so that the apparatus 1 can support the banner.

In this embodiment, the cap is secured to the frame, but the present invention is not limited thereto. Alternatively, the cap may be a rotatable member.

Figure 13:
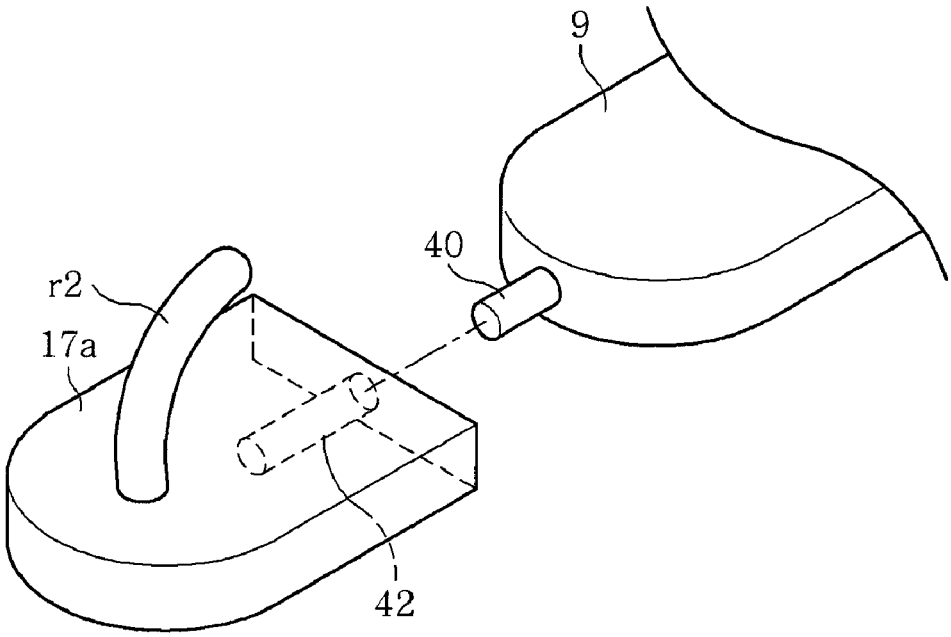
FIG. 13 is a perspective view of another example of the cap of FIG. 12.
Figure 14:
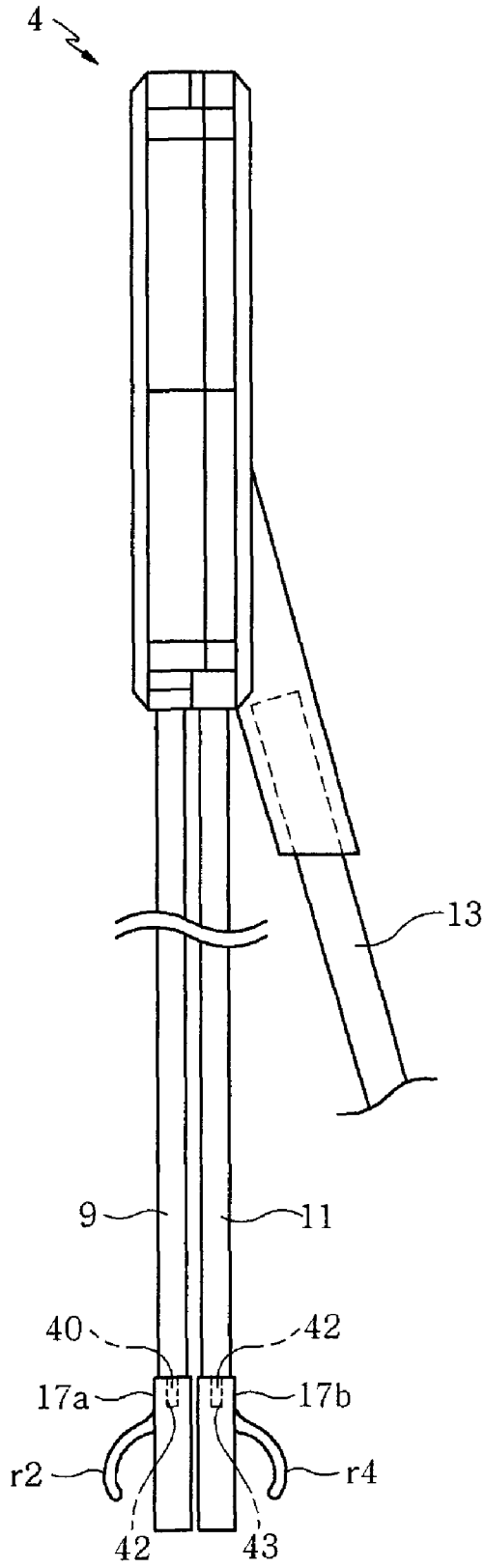
FIG. 14 is a side view of the frames folded by the cap of FIG. 13.

For example, as shown in FIGS. 13 and 14, the second cap 17*a* is rotatably coupled to the end of the second frame 9. That is, the hook r2 protrudes from one side of the second cap 17*a* and is formed with a first insertion hole 42 at one lateral side of the second cap 17*a*. Further, a first insertion shaft 40 protrudes from the end of the second frame 9.

As the first insertion shaft 40 is inserted into the first insertion hole 42 of the second cap 17*a*, the second cap 17*a* can be coupled to the second frame 9.

Here, the first insertion shaft 40 and the first insertion hole 42 have a cylindrical shape, so that the second cap 17*a* can rotate with respect to the second frame 9.

Likewise, the fourth cap 17*b* is rotatably coupled to the end of the fourth frame 11. That is, the hook r4 protrudes from one side of the fourth cap 17*b* and is formed with a second insertion hole 43 at one lateral side of the fourth cap 17*b*. Further, a second insertion shaft 40 protrudes from the end of the fourth frame 11.

As the second insertion shaft 40 is inserted into the second insertion hole 43 of the fourth cap 17*b*, the fourth cap 17*b* is rotatably coupled to the fourth frame 11.

Thus, when the plurality of frames 5, 9, 7, 11 with the rotatable caps is folded, the second and the fourth caps 17*a* and 17*b* are rotated as shown in FIG. 14, so that the hooks r2 and r4 can be positioned opposite each other.

After the second and fourth caps 17*a* and 17*b* are rotated, the second and fourth frames 9, 11 rotatably connected to the connection unit 4 are rotated to overlap each other.

Accordingly, the hooks r2 and r4 are disposed toward outer surfaces of the second and fourth caps 17*a* and 17*b*, respectively, so that a distance between the second and fourth frames 9 can be minimized when the second and fourth frames 9, 11 overlap each other.

As a result, when the apparatus 1 is folded, the second and fourth frames 9, 11 are closed to each other, so that the apparatus 1 can be easily stored in a small bag.

Figure 15:
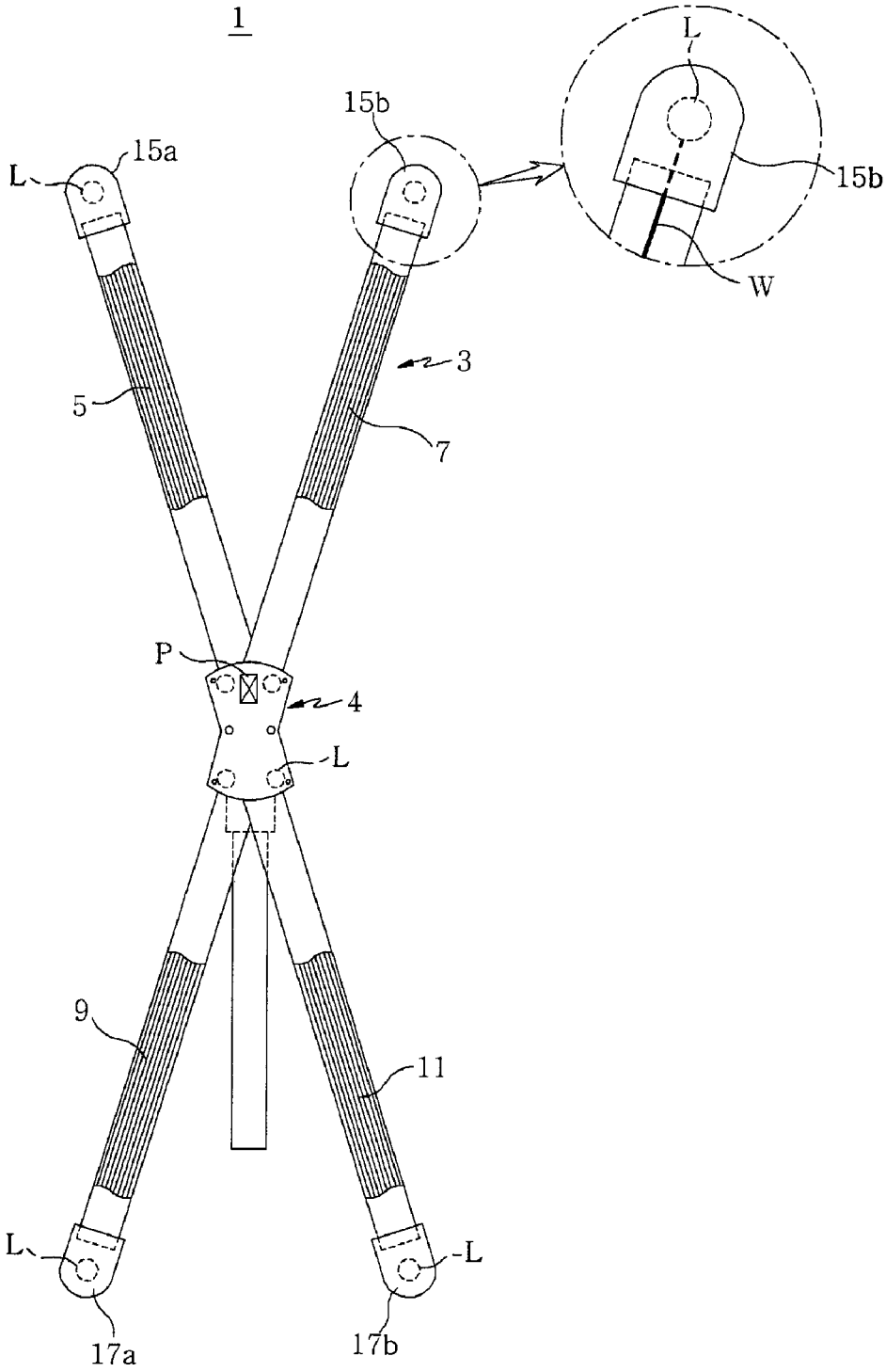
FIG. 15 is a front view of the apparatus of FIG. 1, which includes light emitting members.

FIG. 15 illustrates an apparatus for supporting a banner according to another embodiment of the invention. In this embodiment, the apparatus is provided with light emitting members L to illuminate the banner even at night. Various kinds of light emitting members can be used as the light emitting member L in this embodiment. Advantageously, the apparatus may be provided with light emitting diodes.

The light emitting members L are provided to the caps 15*a*, 15*b*, 17*a*, 17*b* coupled to the ends of the first to fourth frames 5, 7, 9, 11, and to the connection unit 4. In this regard, the caps 15*a*, 15*b*, 17*a* and 17*b* may be transparent or translucent. Further, the light emitting members L are connected to a power supply P provided in the connection unit 4 via a wire W.

When electric power is supplied to the light emitting members L, the light emitting members L emit light via the caps 15*a*, 15*b*, 17*a* and 17*b*, thereby illuminating a banner f.

Figure 16:
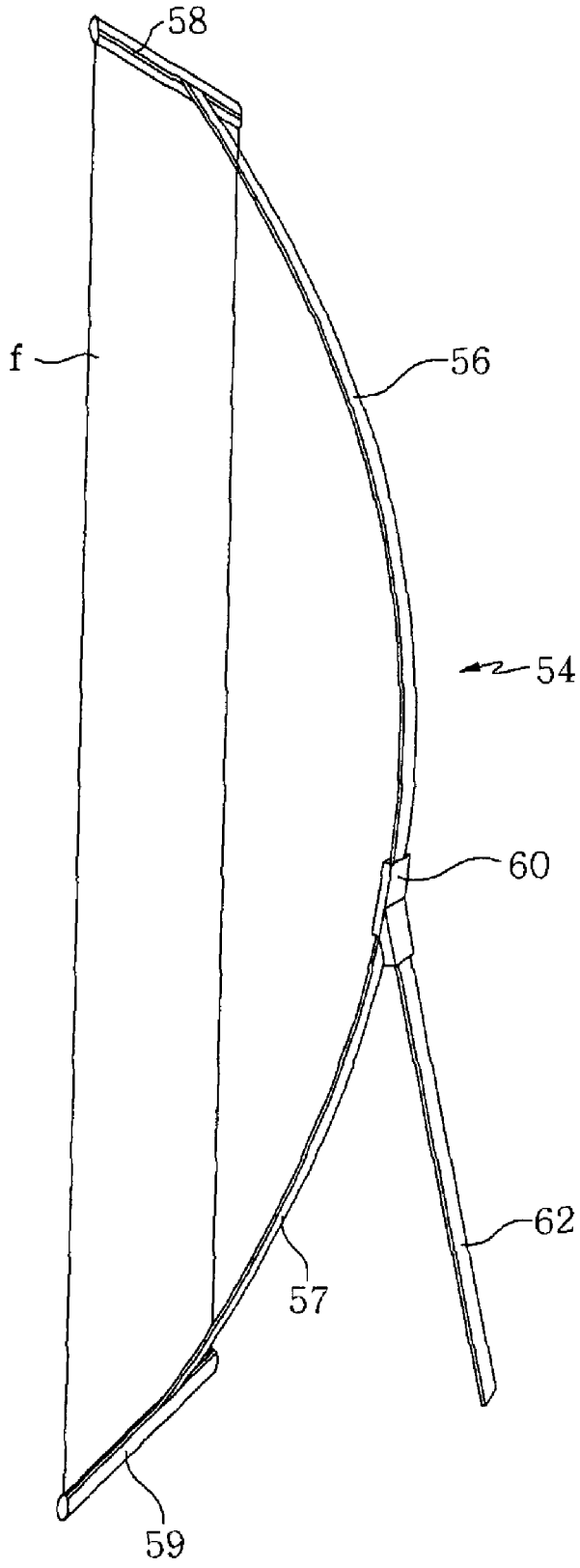
FIG. 16 is a perspective view of an apparatus for supporting a banner according to another embodiment of the present invention.
Figure 17:
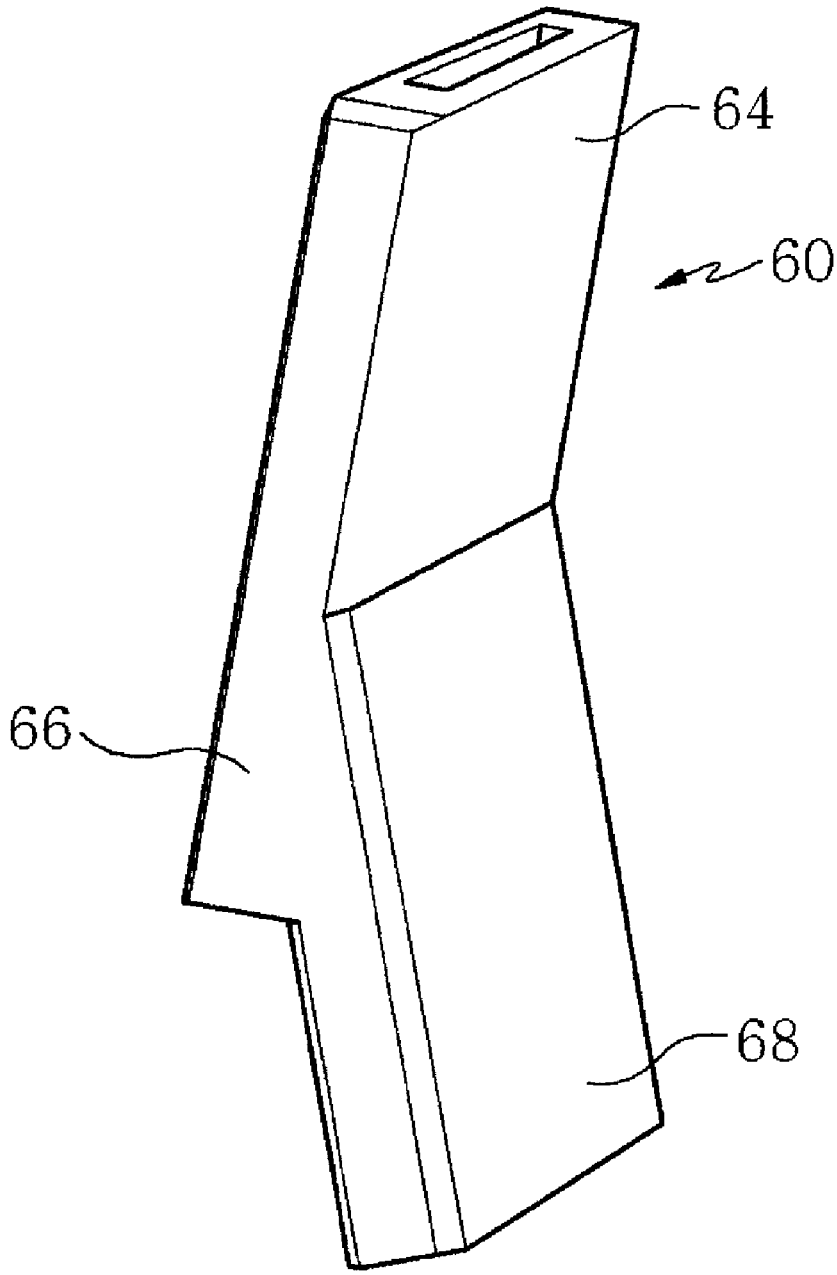
FIG. 17 is a perspective view of a connection unit shown in FIG. 16.

Meanwhile, FIGS. 16 and 17 illustrate an apparatus for supporting a banner according to a further embodiment of the present invention.

The apparatus of this embodiment is equivalent to the aforementioned embodiments in that plural environmentally friendly bamboo plates are adhered to each other to form the banner supporting apparatus. However, the apparatus of this embodiment includes a different supporter.

Specifically, the apparatus for supporting a banner includes a plurality of frames 54 formed by coupling a plurality of bamboo plates to one another; a connection unit 60 connecting the plurality of frames 54 to one another; and supporters, which include upper and lower supporters 58, 59 provided to upper and lower portions of the plurality of frames 54 to support upper and lower sides of a banner f, respectively.

In the apparatus with this configuration, the plurality of frames 54 includes an upper frame 56 inserted into an upper part of the connection unit 60, a lower frame 57 inserted into a lower part of the connection unit 60, and a support frame 62 inserted into the rear of the connection unit 60.

The upper, lower and support frames 56, 57, 62 are made of environmentally friendly bamboo, and have a structure wherein a plurality of bamboo plates are adhered to each other. Thus, these frames may have elasticity of bamboo and rigidity obtained by combining the plurality of bamboo plates.

The connection unit 60 includes an upper insertion part 64 to which a lower end of the upper frame 56 is inserted, a lower insertion part 68 to which an upper end of the lower frame 57 is inserted, and a support frame insertion part 66 to which an upper end of the support frame 62 is inserted.

Thus, the plurality of frames 54 are inserted into the connection unit 60 to assemble the banner supporting apparatus 50, and are separated from the connection unit 60 to disassemble the apparatus 50.

Figure 18:
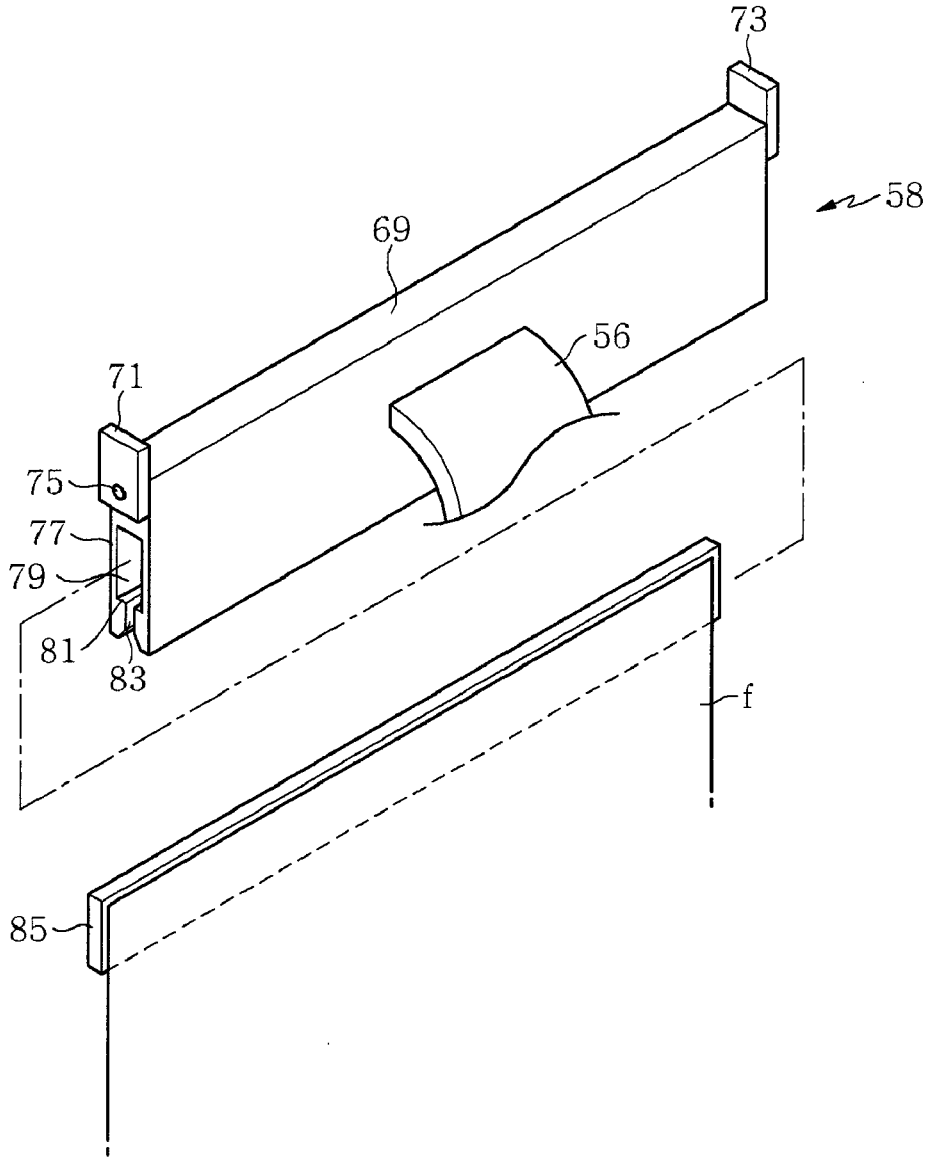
FIG. 18 is an exploded perspective view of an upper supporter shown in FIG. 16.

Further, as shown in FIG. 18, the upper supporter 58 is transversely coupled to the upper portion of the upper frame 56, thereby securing the upper end of the banner f.

Specifically, the upper supporter 58 includes a body 69 having a guide hole 79 longitudinally formed therein; levers 71 rotatably provided to opposite sides of the body 69 to prevent the banner f from being separated in a lateral direction; and a supporting bar 85 inserted into the guide hole 79 and connecting the banner f to the upper supporter 58.

The body 69 of the upper supporter 71 is made of environmentally friendly bamboo. Further, the guide hole 79 is longitudinally formed in the body 69.

Also, a through-hole 83 is longitudinally formed in a lower surface of the body 69, and communicates with the guide hole 79. Further, the body 69 has a step formed above the through-hole 83.

Thus, the supporting bar 85 coupled to the banner f is inserted into the body 69 from a lateral side of the guide hole 79, and the banner f comes out downward through the is through-hole 83, with the supporting bar 85 inserted into the body 69.

Here, the banner f is coupled to one side, i.e., the rear side of the supporting bar 85 by an adhesive. Advantageously, the banner f may be attached to the rear side of the supporting bar 85 via a double-sided adhesive tape.

In addition to the use of the adhesive, various coupling methods, such as a screw coupling method, a clip method, etc., may be used.

Further, the pair of levers 71 is rotatably provided to both sides of the body 69. The levers 71 are coupled to opposite lateral surfaces 77 of the body 69 with hinge pins 75, respectively.

When inserting the supporting bar 85 into the guide hole 79, the pair of levers 71 is rotated upward with respect to the body 69, thereby preventing interference between the supporting bar 85 and the levers 71.

When the supporting bar 85 is completely inserted into the guide hole 79, the pair of levers 71 is rotated downward with respect to the body 69, thereby preventing the supporting bar 85 from being laterally separated by an external force.

On the other hand, in the case that the supporting bar 85 is separated from the guide hole 79, the pair of levers 71 is rotated upward again with respect to the body 69, so that the supporting bar 85 can be separated from the guide hole 79.

The lower supporter 59 has the same configuration as that of the upper supporter 58, and repetitive descriptions will be omitted herein.

Figure 19:
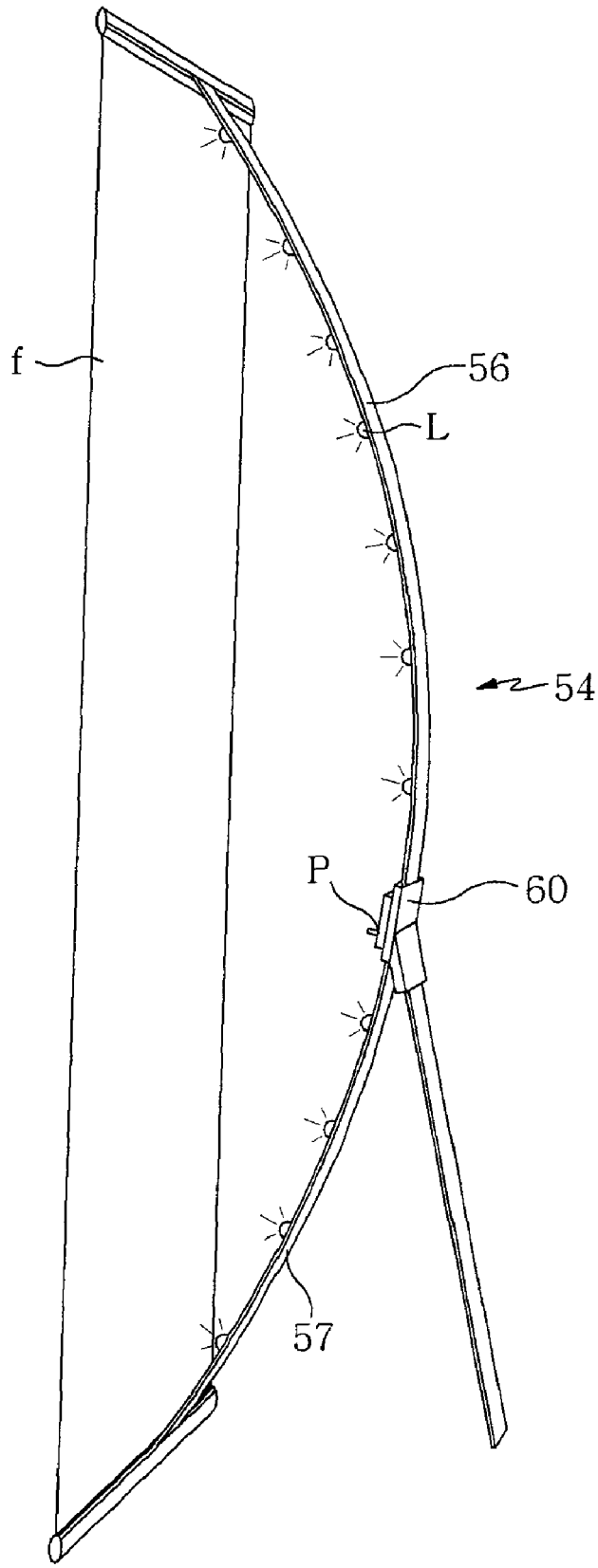
FIG. 19 is a perspective view of the apparatus of FIG. 16, which includes light emitting members.

FIG. 19 illustrates an apparatus for supporting a banner 54 including light emitting members L according to yet another embodiment of the present invention.

In this embodiment, the light emitting members L may include various kinds of light emitting members. The light emitting members L may be light emitting diodes.

The light emitting members L are disposed on inner sides of the upper and lower frames 56 and 57, and connected to a power supply P in the connection unit 60.

When electric power is supplied to the light emitting members L, the light emitting members L emit light and illuminate the banner f.

Figure 20:
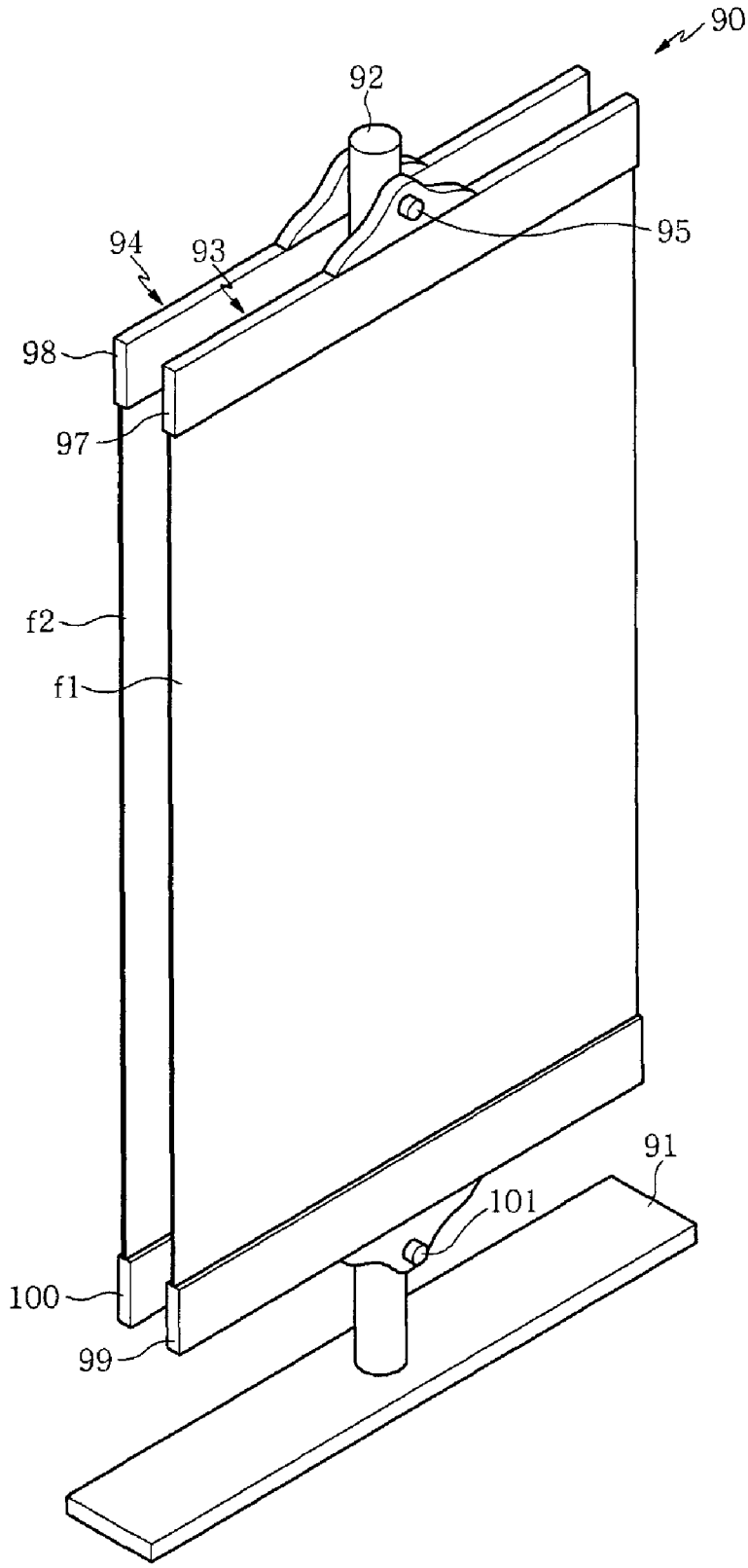
FIG. 20 is a perspective view of an apparatus for supporting a banner according to a further embodiment of the present invention.
Figure 21:
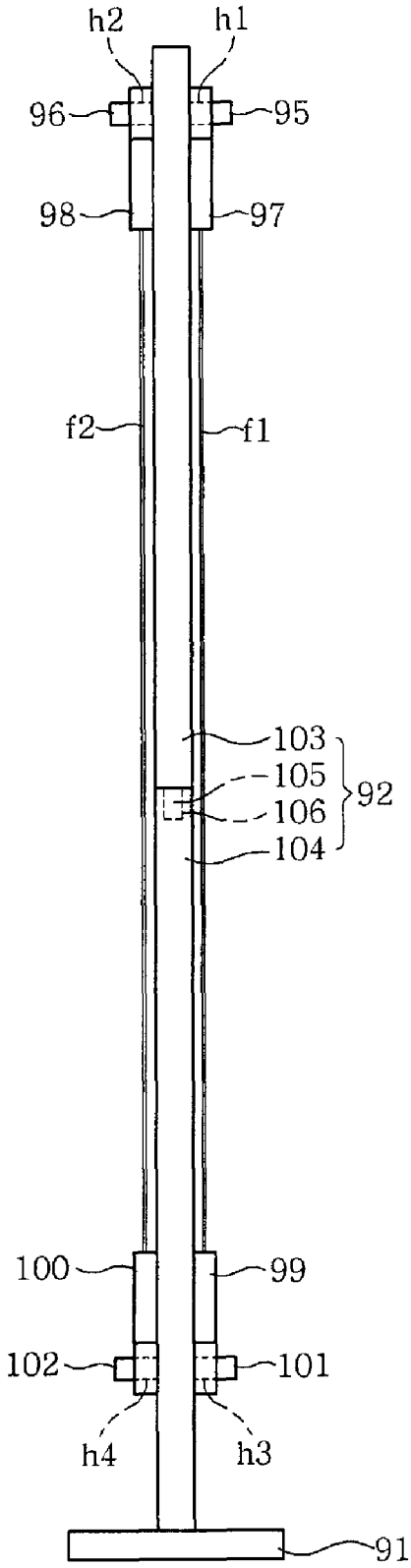
FIG. 21 is a side view of the apparatus of FIG. 20.

FIGS. 20 and 21 illustrate an apparatus for supporting a banner according to yet another embodiment of the present invention. As shown therein, the banner supporting apparatus 90 of this embodiment includes a pedestal 91, a supporter 92 disposed on the pedestal 91, and a pair of frames 93, 94 provided at front and rear sides of the supporter 92 to hold banners f1, f2.

In the apparatus this embodiment, the supporter 92 includes an upper pole 103 and a lower pole 104. Here, a projection 105 protrudes from the bottom of the upper pole 103, and a groove 106 is formed on the top of the lower pole 104.

Thus, the projection 105 of the upper pole 103 is inserted into the groove 106 of the lower pole 104, thereby assembling the supporter 92.

The supporter 92 includes first and second upper pins 95, 96 protruding from an upper portion thereof, and first and second lower pins 101, 102 protruding from a lower portion thereof.

The pair of frames 93, 94 includes a front frame 93 provided in front of the supporter 92, and a back frame 94 provided in back of the supporter 92.

Here, each of the frames 93, 94 is formed by attaching a plurality of bamboo plates to each other.

The front frame 93 includes a first upper supporter 97 coupled to the first upper pin 95 of the supporter 92, and a first lower supporter 99 coupled to the first lower pin 101, so that the banners f1, f2 can be held by the first upper and lower supporters 97, 99.

The back frame 94 has the same configuration as that of the front frame 93. That is, the back frame 94 includes a second upper supporter 98 coupled to the second upper pin 96, and a second lower supporter 100 coupled to the second lower pin 102.

Thus, the banners f1 and f2 can be held by the second upper and lower supporters 97 and 99.

Figure 22:
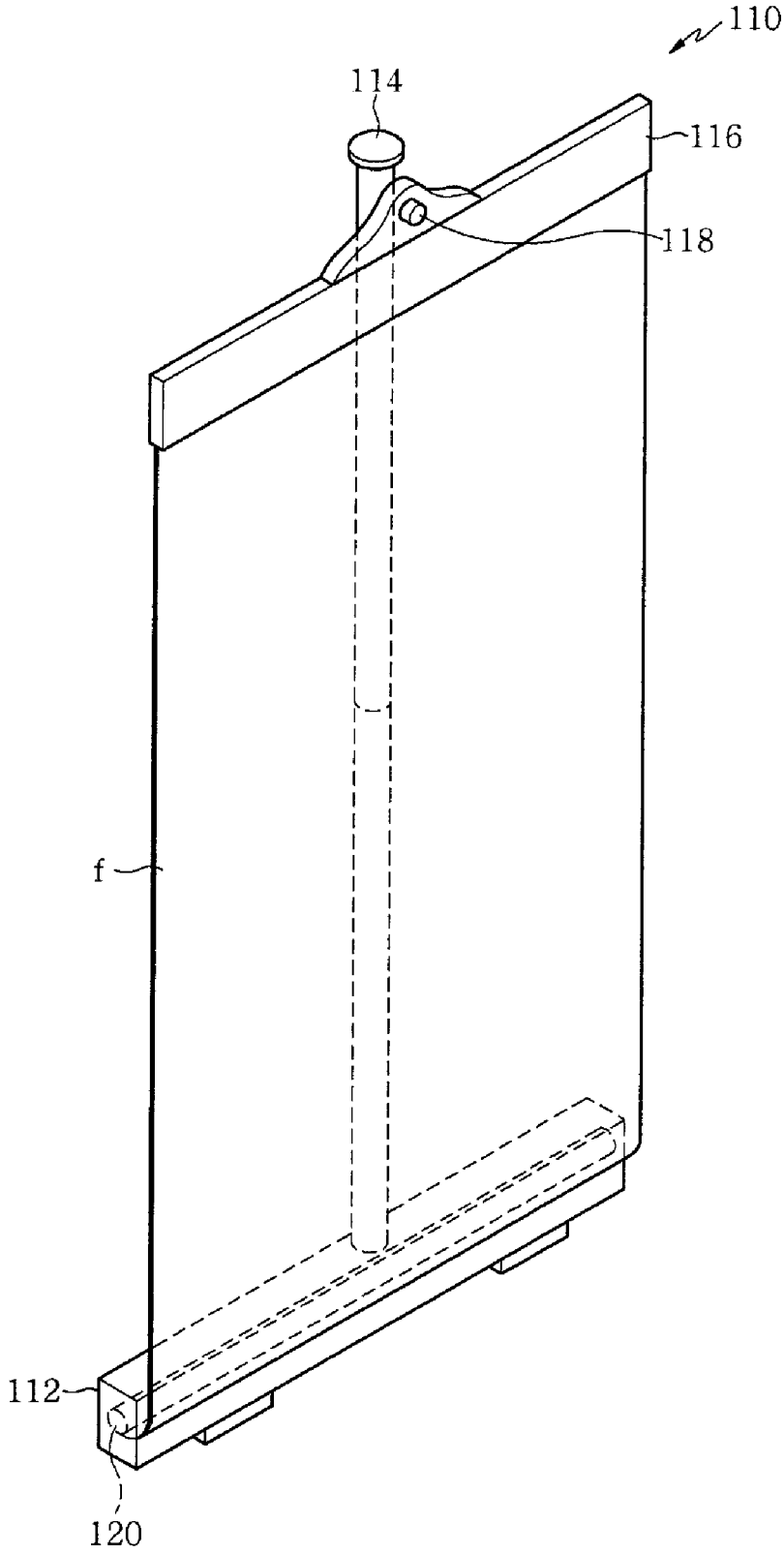
FIG. 22 is a perspective view of a scroll type banner supporting apparatus according to yet another embodiment of the present invention.
Figure 23:
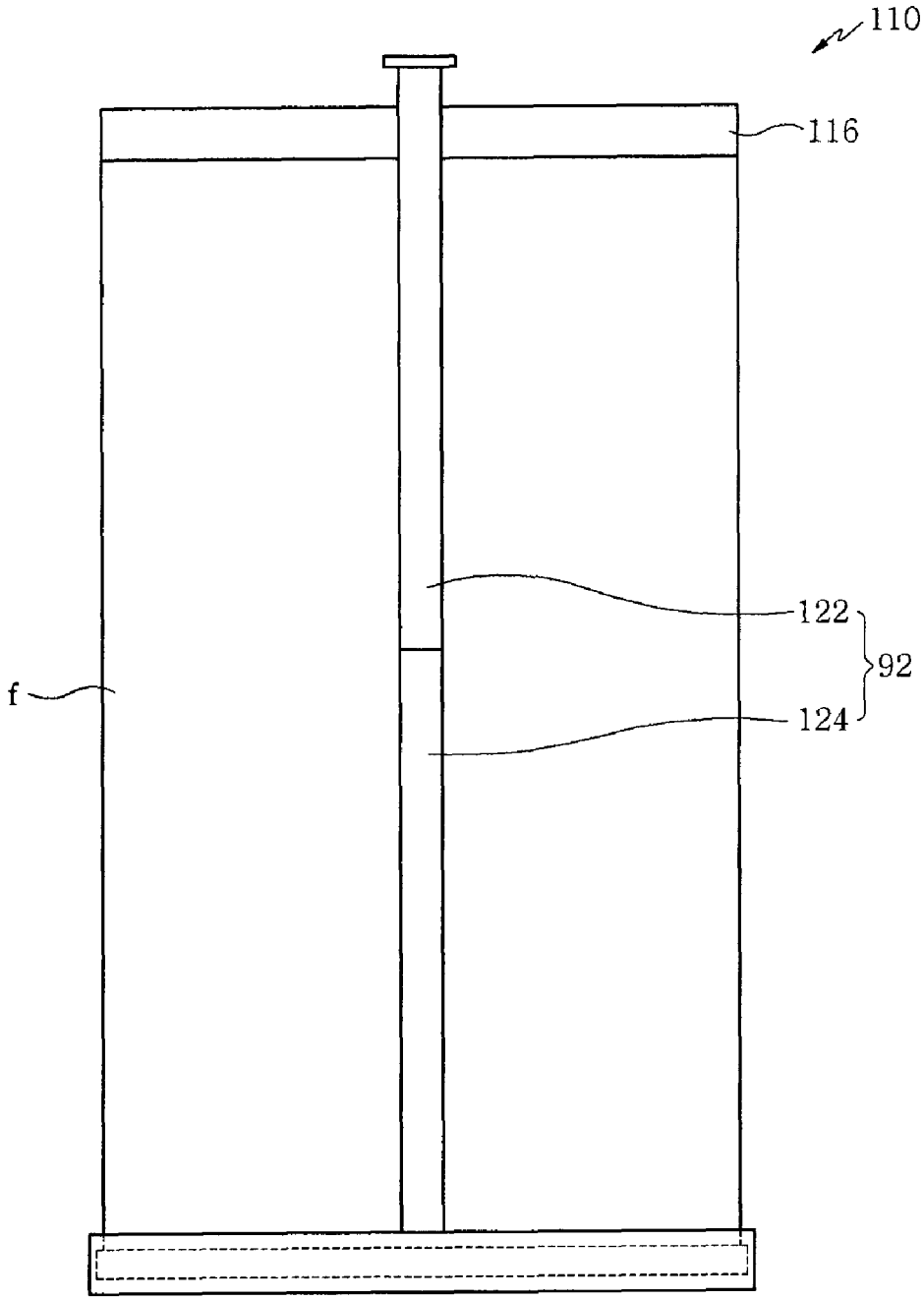
FIG. 23 is a rear view of the apparatus of FIG. 22.

FIGS. 22 and 23 illustrate an apparatus for supporting a banner according to yet another embodiment of the present invention.

As shown therein, the banner supporting apparatus 110 of this embodiment includes a pedestal 112, a supporter 114 disposed on the pedestal 112, a frame 116 disposed in front of the supporter 114 to hold a banner f, and a roller 120 on which a lower part of the banner f held by the frame 116 is wound.

In the apparatus for supporting a banner 110 of this embodiment, the supporter is 114 includes an upper pole 122 and a lower pole 124.

Thus, the upper pole 122 and the lower pole 124 are assembled to constitute the supporter 114. Further, an upper pin 118 protrudes from an upper portion of the supporter 114.

The frame 116 is also manufactured by attaching a plurality of bamboo plates to each other.

The frame 116 is coupled to the upper pin 118. Then, an upper part of the banner f is coupled to the upper pin 118, and a lower part thereof is wound on the roller 120.

The roller 120 is rotatably disposed inside the pedestal 112, and elastically supported to be rotated in one direction by an elastic member (not shown), such as a spring or the like.

With this configuration, when the frame 116 is pulled up and coupled to the upper pin 118 with the banner f wound by the roller 120 in one direction, the roller 120 is rotated to unroll the banner f.

Figure 24:
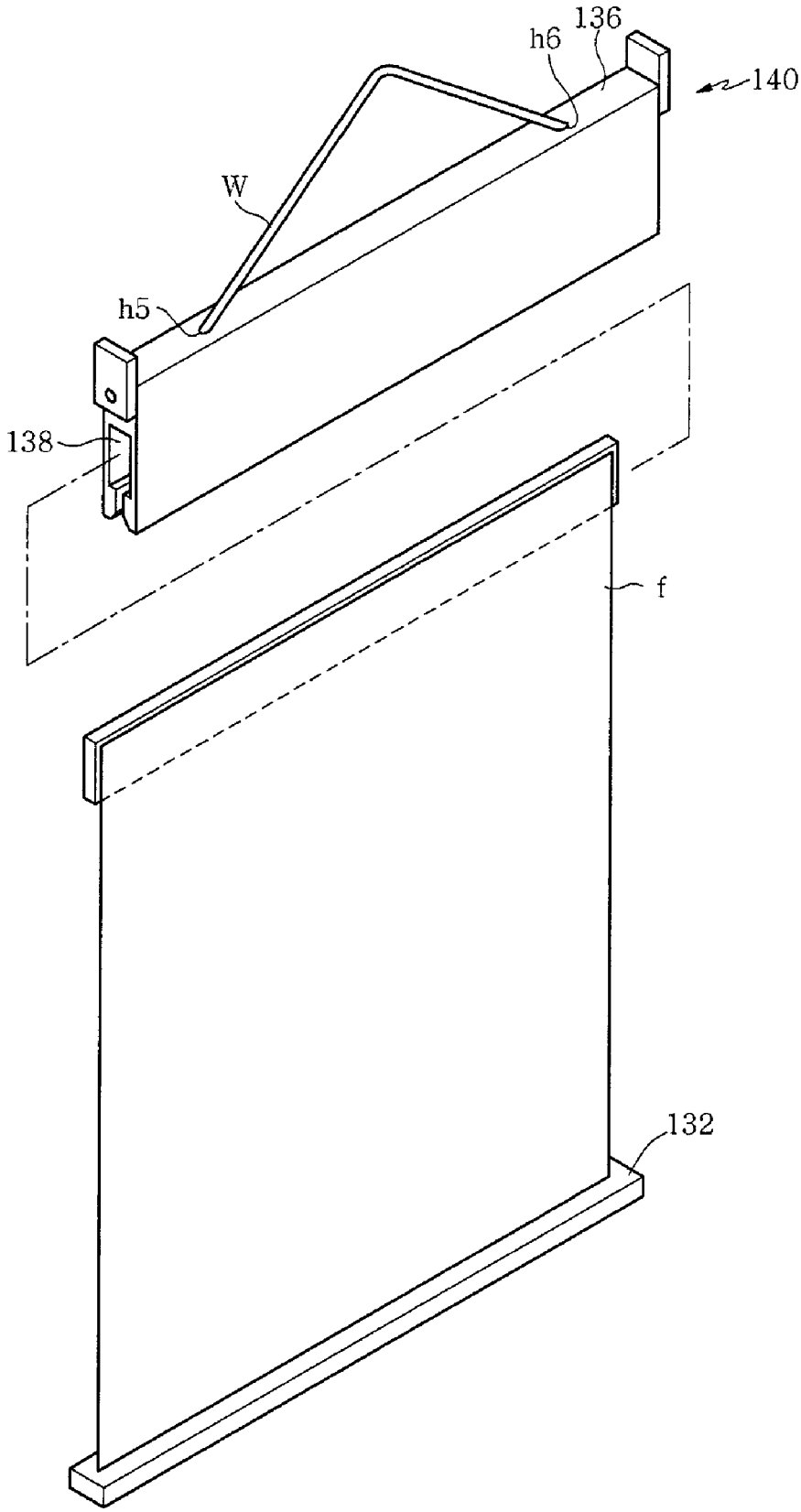
FIG. 24 is a perspective view of a wall-hanging type banner supporting apparatus according to yet another embodiment of the present invention.
Figure 25:
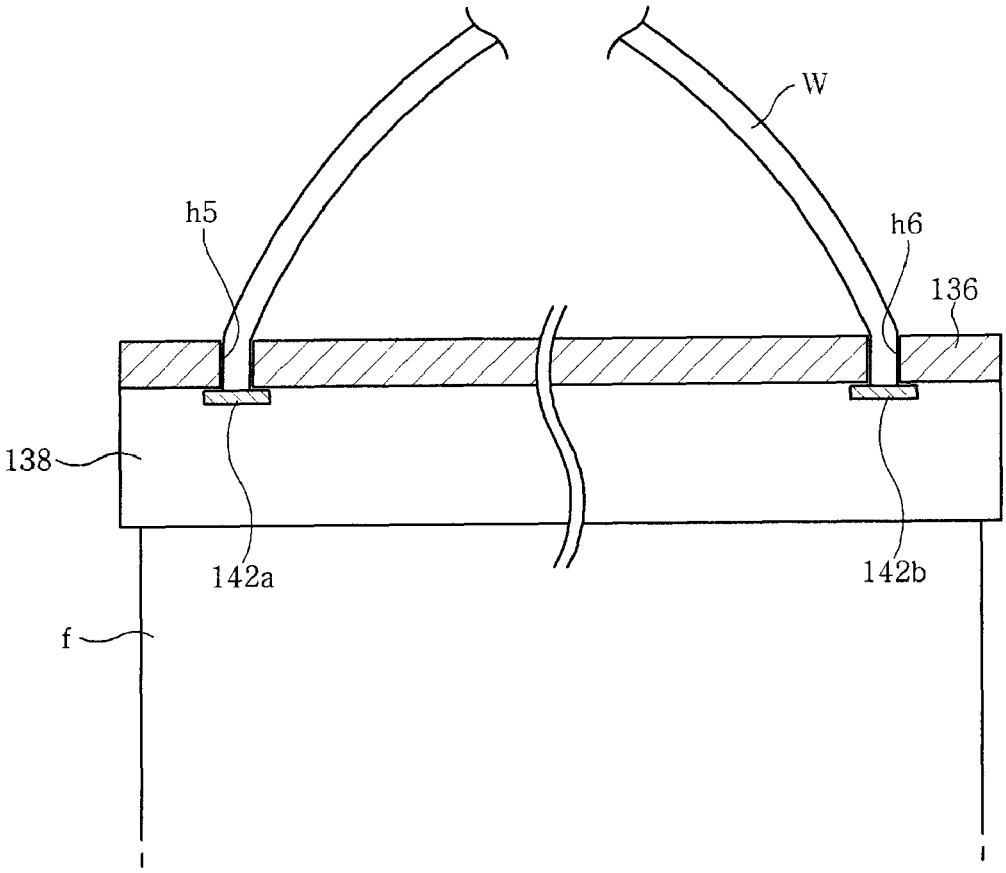
FIG. 25 is a sectional view illustrating an inner structure of a frame shown in FIG. 24.

FIGS. 24 and 25 illustrate an apparatus for supporting a banner according to yet another embodiment of the present invention. As shown therein, the banner supporting apparatus of this embodiment includes a frame 140 to which an upper part of a banner f is connected, and a pedestal 132 where a lower part of the banner f is connected.

Further, a wire W is connected to the frame 140, so that the frame 140 can be hung from a nail or a pin on a wall or the like.

In other words, the frame 140 is formed with holes h5, h6 at opposite upper sides of a body 136 of the frame, and opposite ends of the wire W are inserted into the holes h5 and h6.

Here, latch bars 142*a*, 142*b* are connected to both ends of the wire W. The latch bars 142*a*, 142*b* are formed to be longer than the diameters of the holes h5 and h6, respectively.

Therefore, one end of each of the latch bars 142*a*, 142*b* is inserted into the hole h5 or h6 after being arranged in parallel to the length of the wire W such that the latch bars 142*a*, 142*b* can be located inside a guide hole 138 formed in the body 136 after passing through the holes h5 and h6.

In this state, when the wire W is pulled, the latch bars 142*a*, 142*b* come into contact with the inner surface of the guide hole 138 and are prevented from being separated from the frame via the holes h5, h6.

When using this apparatus 130 to hang the banner f, the wire W of the frame 132 is hung from the nail on the wall or the like by suspending the banner f downward.

As apparent from the above description, the apparatus for supporting a banner according to the embodiment of the present invention employs bamboo, thereby obtaining environmental friendliness.

The apparatus for supporting a banner according to the embodiment of the present invention includes a plurality of bamboo plates adhered to each other and integrated into a single body, thereby obtaining both elasticity and rigidity of bamboo.

The apparatus according to the embodiment of this invention includes a rotatable cap at a distal end of a frame, so that a distance between the frames can be minimized to be stored in a small storage space when the apparatus is folded.

The apparatus according to the embodiment of this invention includes a wire connected to an upper supporter, so that the banner can be easily and securely supported.

Although the present invention has been described with reference to the embodiments and the accompanying drawings, it will be apparent to those skilled in the art that the embodiments are given by way of illustration, and that various modifications and equivalent embodiments can be made without departing from the spirit and scope of the present invention Accordingly, the scope of the present invention should be limited only by the accompanying claims as set forth below.

What is claimed is:

1. An apparatus for supporting a flexible banner, comprising:

a plurality of flexible frames comprising upper and lower frames, each frame comprising a plurality of stacked, flexible plates;

a connection unit having an interior cover and an exterior cover for connecting the plurality of frames to each other by removably inserting at least one of the upper and lower frames into the interior cover and another at least one of the upper and lower frames into the exterior cover, wherein the interior and exterior covers comprise insertion parts for receiving the upper and lower frames, and wherein a width and a thickness of an individual insertion part is at least as great as a width and thickness of an individual upper or lower frame;

a supporter at an end of each of the plurality of frames, each supporter comprising an attachment device to support the banner which is shaped to force outer edges of the banner outward away from the connection unit; and a support frame connected to one side of the connection unit to support the plurality of frames;

wherein a combined length of the at least one of the upper and lower frames and the another at least one of the upper and lower frames is less than a diagonal corner-to-corner length of the banner such that the plurality of flexible frames are flexed and the banner is held taut when the banner is supported by the plurality of flexible frames.

2. The apparatus according to claim 1, wherein the stacked, flexible plates comprise a plurality of bamboo plates adhered to one another.

3. The apparatus according to claim 1, wherein the interior cover of the connection unit comprises an interior case, and wherein the insertion parts comprise a first insertion part formed at one side of the interior case, a second insertion part formed at the other side of the interior case, and wherein a first projection protrudes from the second insertion part, and the exterior cover comprises an exterior case, and wherein the insertion parts further comprise a third insertion part formed at one side of the exterior case, a fourth insertion part formed at the other side of the exterior case, and wherein a second projection protrudes from the fourth insertion part, and a fifth insertion part protrudes from the exterior case such that the support frame is inserted into the fifth insertion part.

4. The apparatus according to claim 3, wherein the plurality of frames comprises a first frame inserted into the first insertion part of the connection unit, a second frame inserted into the second insertion part and having a through-hole at one end thereof into which the first projection is inserted, a third frame inserted into the third insertion part, and a fourth frame inserted into the fourth insertion part and having a through-hole at one end thereof into which the second projection is inserted, the first and third frames supporting a banner.

5. The apparatus according to claim 4, wherein the supporter comprises a cap having an insertion hole and is inserted onto each end of the plurality of frames, and each of the second and fourth frames comprises first and second insertion shafts protruding from the end thereof along a longitudinal axis thereof to be inserted into the insertion hole of the cap such that the cap can axially rotate around the longitudinal axis of the second and fourth frames, respectively.

6. The apparatus according to claim 1, wherein the connection unit comprises:

an upper insertion part into which lower ends of a plurality of upper frames is are inserted;

a lower insertion part into which upper ends of a plurality of lower frames is are inserted, wherein the upper ends overlap one another within the connection unit; and a support frame insertion part into which an upper end of the support frame is inserted.

7. The apparatus according to claim 1, wherein the frames comprise light emitting members on inner sides thereof.

8. The apparatus according to claim 1, further comprising:

a roller on which a part of the banner supported by the frame is wound.

9. The apparatus according to claim 1, wherein the attachment device comprises a hook having an end pointed outwardly from the connection unit.

10. The apparatus according to claim 1, wherein the width or thickness of an individual lower insertion part of the connection unit is greater than the width or thickness of the individual lower frame, and wherein the lower frame is rotatably received in the individual lower insertion part.

11. The apparatus according to claim 1, wherein the lower frame comprises a plurality of lower frames rotatably and overlappingly received in lower insertion parts, the upper frame comprises a plurality of upper frames non-rotatably received in upper insertion parts, the plurality of lower frames each comprise an insertion shaft, the plurality of upper frames each comprise an insertion shaft, the supporters each comprise an insertion hole for receiving the insertion shafts on the upper and lower frames, and wherein the supporters are held onto the end of each of the plurality of frames by tension from the banner.

12. An apparatus for supporting a flexible banner, comprising:

a plurality of flexible frames comprising upper and lower frames, each frame comprising a plurality of stacked, flexible plates;

a connection unit having an interior cover and an exterior cover for connecting the plurality of frames to each other by inserting at least one of the upper and lower frames into the interior cover and another at least one of the upper and lower frames into the and exterior cover, wherein the interior and exterior covers comprise insertion parts for receiving the upper and lower frames, and wherein a width and a thickness of an individual insertion part is at least as great as a width and thickness of an individual upper or lower frame;

a supporter at an end of each of the plurality of frames, each supporter comprising an attachment device to support the banner which is shaped to force outer edges of the banner outward away from the connection unit; and a support frame connected to one side of the connection unit to support the plurality of frames, wherein a combined length of the at least one of the upper and lower frames and the another at least one of the upper and lower frames is less than a diagonal corner-to-corner length of the banner and wherein the plurality of flexible frames comprises front frames in front of the supporter and the apparatus further comprises back frames provided in back of the supporter, the front and back frames being configured to support front and back banners.

13. An apparatus for supporting a banner, comprising:

a plurality of frames, each comprising a plurality of stacked plates;

a connection unit having an interior cover and an exterior cover connected to each other by inserting the plurality of frames into the interior and exterior covers, respectively;

a supporter provided to each end of the plurality of frames to support the banner; and a support frame connected to one side of the connection unit to support the plurality of frames;

wherein the interior cover of the connection unit comprises an interior case, a first insertion part formed at one side of the interior case, a second insertion part formed at another side of the interior case, and a first projection protruding from the second insertion part, and the exterior cover comprises an exterior case, a third insertion part formed at one side of the exterior case, a fourth insertion part formed at another side of the exterior case, and a second projection protruding from the fourth insertion part, the plurality of frames comprises a first frame inserted into the first insertion part or separated from the first insertion part of the connection unit, a second frame inserted into the second insertion part and having a through-hole at one end thereof into which the first projection is inserted, a third frame inserted into the third insertion part or separated from the third insertion part, and a fourth frame inserted into the fourth insertion part and having a through-hole at one end thereof into which the second projection is inserted, and the supporter comprises a cap having an insertion hole and the cap is inserted onto an end of each of the plurality of frames, and each of the second and fourth frames comprises first and second insertion shafts protruding from the end thereof to be inserted into the insertion hole of the cap such that the caps on the second and fourth frames can rotate to be positioned opposite each other to minimize the distance between the second and fourth frames when the second and fourth frames overlap each other.

14. A method for supporting a flexible banner with a banner support apparatus, the banner support apparatus comprising:

a plurality of flexible frames comprising upper and lower frames, each frame comprising a plurality of stacked, flexible plates;

a connection unit having an interior cover and an exterior cover for connecting the plurality of frames to each other by inserting at least one of the upper and lower frames into the interior cover and another at least one of the upper and lower frames into the exterior cover, wherein the interior and exterior covers comprise insertion parts for receiving the upper and lower frames, and wherein a width and a thickness of an individual insertion part is at least as great as a width and thickness of an individual upper or lower frame;

a supporter at an end of each of the plurality of frames, each supporter comprising an attachment device to support the banner which is shaped to force outer edges of the banner outward away from the connection unit; and a support frame connected to one side of the connection unit to support the plurality of frames;

wherein a combined length of the at least one of the upper and lower frames and the another at least one of the upper and lower frames is less than a diagonal corner-to-corner length of the banner;

the method comprising:

attaching a lower portion of the banner to an attachment device on a lower frame;

bending at least one of the upper and lower frames; and attaching an upper portion of the banner to an attachment device on an upper frame.

15. The method of claim 14, further comprising rotating the attachment device on the lower frame from a storage position to a support position.

16. The method of claim 14, wherein the lower frame comprises a plurality of lower frames, the method further comprising moving the plurality of lower frames from a folded position to an unfolded position, wherein the folded position comprises an adjacent overlapping position where the lower frames are adjacent to one another and overlap along a majority of a length of the lower frames.

17. The method of claim 14, further comprising illuminating the banner:

from behind the banner using light emitting diodes on the upper and lower frames; or from sides of the banner using light emitting diodes on the supporters.

* * * * *